United States Patent [19]

Trendl

[11] Patent Number: 4,760,617

[45] Date of Patent: Aug. 2, 1988

[54] LEVEL DYEING OF A FILAMENT BUNDLE WITH A DYE SOLUTION

[75] Inventor: Franz Trendl, Ludwigshafen, Fed. Rep. of Germany

[73] Assignee: BASF Aktiengesellschaft, Ludwigshafen, Fed. Rep. of Germany

[21] Appl. No.: 887,943

[22] Filed: Jul. 22, 1986

[30] Foreign Application Priority Data

Aug. 2, 1985 [DE] Fed. Rep. of Germany ..... 3527799

[51] Int. Cl.[4] ..... D06B 3/04

[52] U.S. Cl. ..... 8/151.2; 28/182; 68/175

[58] Field of Search ..... 8/151.2; 68/38, 43, 68/53, 158, 175; 28/182, 183, 282

[56] References Cited

U.S. PATENT DOCUMENTS

| | | | |
|---|---|---|---|
| 2,219,582 | 10/1940 | Tarbox | 68/175 X |
| 3,026,167 | 3/1962 | Hofmann et al. | 8/151.2 |
| 3,136,146 | 6/1964 | Bailey | 68/175 X |
| 3,708,832 | 1/1973 | Lohrke | 28/282 |

FOREIGN PATENT DOCUMENTS

| | | | |
|---|---|---|---|
| 18050 | 8/1965 | Japan | 28/282 |

*Primary Examiner*—Philip R. Coe
*Attorney, Agent, or Firm*—Keil & Weinkauf

[57] ABSTRACT

A filament bundle comprising a plurality of filaments is dyed level with a dye solution during continuous dyeing of the filament bundle by opening the filament bundle during dyeing in the horizontal and vertical direction by means of a driven roll having a sawtoothlike thread profile.

1 Claim, 2 Drawing Sheets

LEVEL DYEING OF A FILAMENT BUNDLE WITH A DYE SOLUTION

The invention relates to a process for the level dyeing of a bundle of a plurality of filaments with a dye solution during the continuous dyeing of the filament bundle.

The process described above serves the level finishing or dyeing of artificial and synthetic filament bundles, for example acrylic filaments, during their production by wet spinning.

It is known to producer-dye filaments, for example acrylic filaments, in the gel state. Owing to unsatisfactory conditions in the dyebath, the levelness of the dyeing is frequently unsatisfactory. Depending on the local packing density and tension of the filament bundle (frequently also referred to as tow), the depth of shade on the filaments varies across the cross-section of the bundle. Despite thorough blending in the course of subsequent yarn manufacture, the appearance of the textiles produced therefrom is skittery. Despite equipping the dyeing trough with rotating structures, for example reels with circumferentially attached rods, with which the filament bundle is beaten periodically, it is not possible to obtain a level dyeing on the individual filaments.

It is an object of the present invention to develop a simple process for uniformly penetrating the filament bundle with a dye solution to obtain, eventually, a level dyeing on the corresponding textiles.

We have found that this object is achieved, according to the invention, by opening the filament bundle during dyeing in the horizontal and vertical direction by means of a driven roll having a sawtoothlike thread profile.

An illustrative embodiment of the invention with the essential inventive features is depicted in the drawing and will be further described hereinafter. The drawing shows the principle of the process and apparatus.

Figure 1:
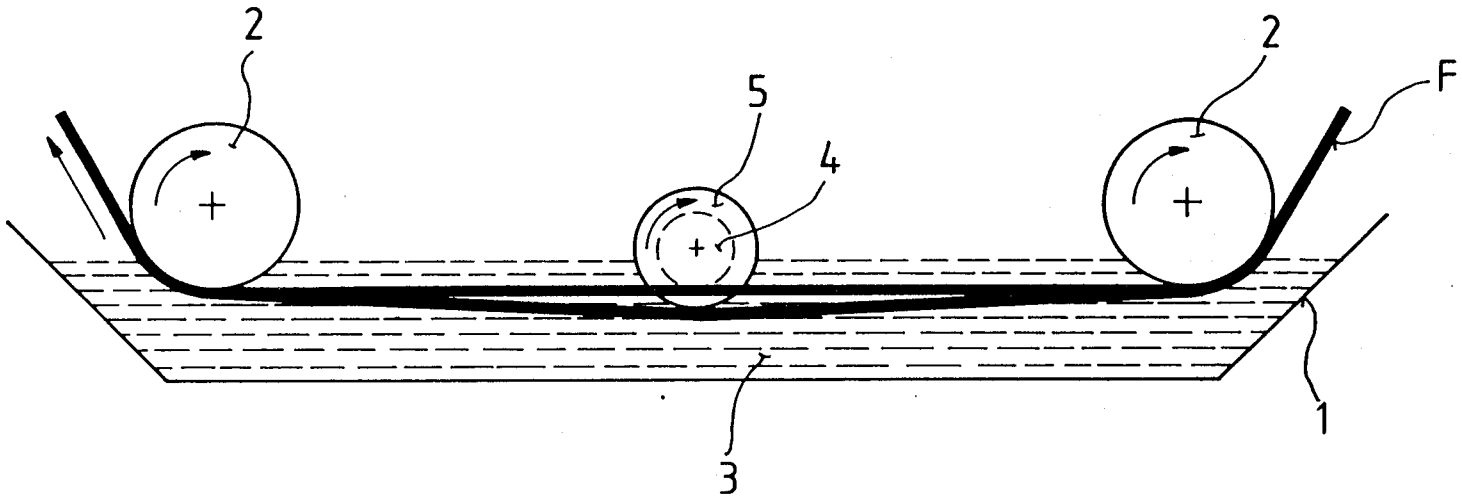
FIG. 1 shows a section through a conventional dyeing trough.
Figure 2:
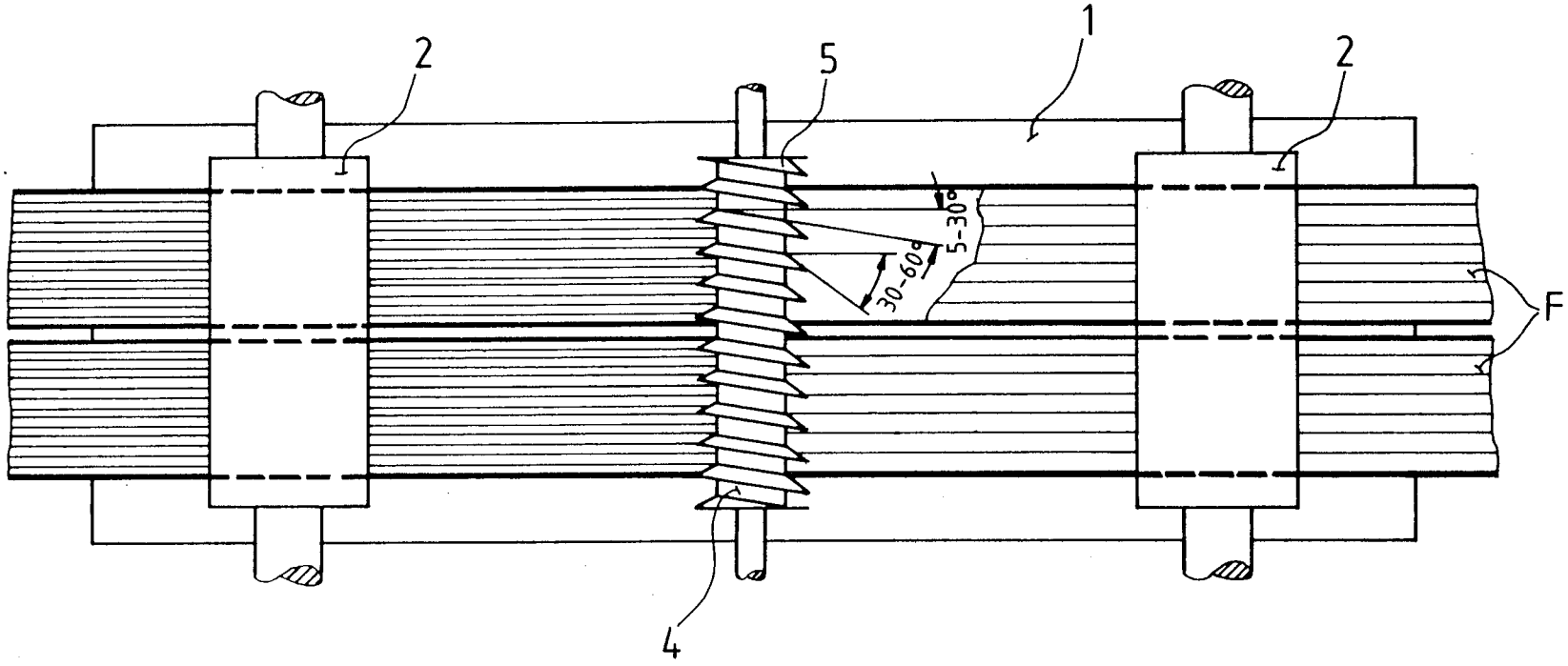
FIG. 2 shows a top view of a conventional dyeing trough.

In this matter it can be regarded as common knowledge that the filament bundle F is dyed in a conventional manner in a dyeing trough 1 which is equipped with two deflecting rollers 2 with a dye solution 3 present in the dyeing trough. A driven roll 4 which is equipped with a special sawtoothlike thread profile 5 which engages into the filament bundle splits said bundle into many narrow ribbons. It is the crests of the thread profile which engage into the filament bundle, and as a consequence of the special construction of the thread profile, namely obliquely to the axis of the roll, the locus of splitting into the narrow ribbons is continuously displaced laterally (horizontally). As a consequence, even extremely fine filament bundles are repeatedly flushed by the dye solution during their passage through the dyeing trough and, in the course of that passage, take up dye uniformly.

Furthermore, the lateral movement of the thread profile has the effect of forcing the fine filament bundles, after a slight lateral deflection, to climb up the oblique side of the sawtoothlike thread profile and then, after moving across the crest, to descend back into the root of the thread. Constant repetition of this process has the effect of superposing on the movement of the filament bundles in the vertical direction a vibration which continues as far as the deflecting rolls. As a consequence, the thorough contact between the individual filament and the dye solution is increased, which helps to increase the levelness of the dyeing.

The thread profile which is present in the dye solution acts like a conveyor screw and effects through mixing of the dye solution in a transverse direction of the dyeing trough. This ensures the supply of previously undepleted dye solution and additionally increases the levelness of dyeing on the individual filament bundles.

The sawtoothlike thread profile can engage into the filament bundle not only downwardly but also upwardly.

The advantages obtained with the invention exist in particular in the finishing of artificial and synthetic filaments during their production to obtain high levelness of dyeing.

In the processing of thicker filament bundles of higher linear densities, the levelness can be ensured in a simple manner by changing the speed of rotation of the roll and by replacing the roll for a roll having a different thread profile (lead, depth and root of thread).

However, the process and apparatus can also be advantageously used elsewhere in the production plant, namely wherever thorough mass transfer is desirable, as for example in wash baths to remove spinning solvent, in the washoff of unfixed dye after dyeing, and in baths for applying spin finish or other products.

I claim:

1. A process for the level dyeing of a bundle of a plurality of filaments with a dye solution during the continuous dyeing of the filament bundle, which comprises opening the filament bundle during dyeing in the horizontal and vertical direction by means of a driven roll having a sawtoothlike thread profile across its entire width thereby splitting said bundle into many narrow ribbons.

* * * * *